US005435568A

United States Patent [19]

Black

[11] Patent Number: 5,435,568

[45] Date of Patent: Jul. 25, 1995

[54] CARD GAMES TO RECREATE SOME OF THE ATOMOSPHERE OF THE MIDDLE AGES

[76] Inventor: P. Gregory Black, 4751-B Montrose Road, Niagra Falls, Ontario, Canada, L2H 1K4

[21] Appl. No.: 150,994

[22] Filed: Nov. 12, 1993

[51] Int. Cl.[6] ..... A63F 1/00

[52] U.S. Cl. ..... 273/303; 273/308

[58] Field of Search ..... 273/292, 302–308

[56] References Cited

U.S. PATENT DOCUMENTS

| | | | |
|---|---|---|---|
| 1,117,316 | 11/1914 | Booton | 273/306 |
| 1,287,317 | 10/1918 | Hopkins | 273/306 |
| 1,355,782 | 10/1920 | Roy | 273/306 |
| 1,357,166 | 10/1920 | Hart | 273/308 |
| 1,631,009 | 5/1927 | Clark | 273/306 |

FOREIGN PATENT DOCUMENTS

| | | | |
|---|---|---|---|
| 4360 | of 1904 | United Kingdom | 273/303 |

*Primary Examiner*—Benjamin H. Layno

[57] ABSTRACT

A card game adapted to recreate some of the atmosphere of combat in the Middle Ages comprising, in combination, a rule book; a score pad; and a deck of cards, the deck of cards including a plurality of cards comprised of five different card type identifications vertically marked along one side including land, personalities, naval, fortifications and assault, each card also including horizontally across the top a subdivision identification and for land type cards a unit identification including foot, horse and range, each card also having on its face a picture indicative of the subdivision and a number representing the point value assigned to the card.

2 Claims, 3 Drawing Sheets

FIG. 1
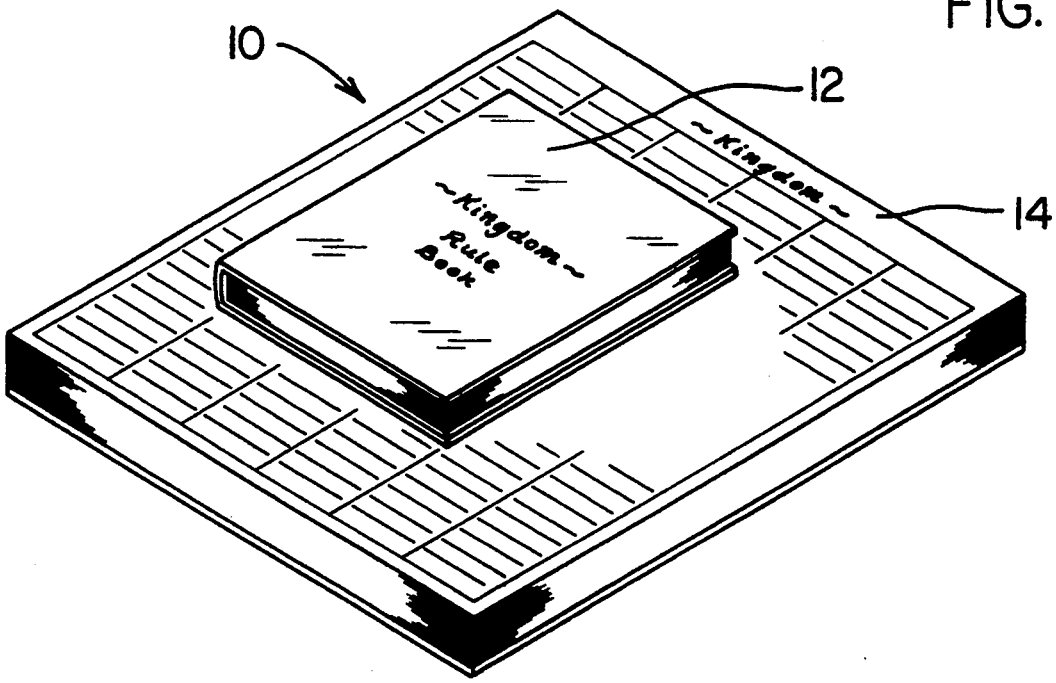
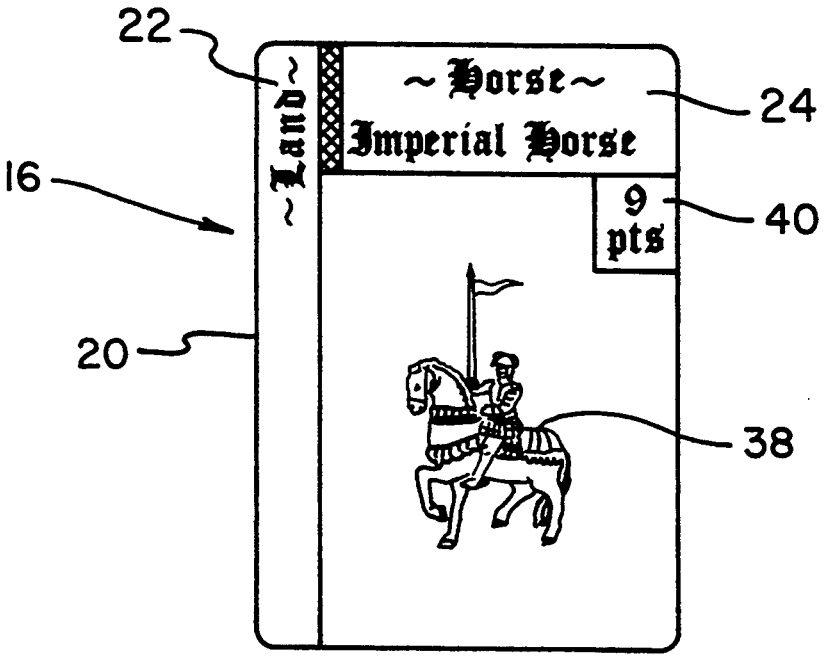
FIG. 2

CARD GAMES TO RECREATE SOME OF THE ATOMOSPHERE OF THE MIDDLE AGES

BACKGROUND OF THE INVENTION

1. Field of the Invention

The present invention relates to card games to recreate some of the atmosphere of the Middle Ages and more particularly pertains to playing a card game of skill and chance which includes cards which evoke the atmosphere of the Middle Ages.

2. Description of the Prior Art

The use of card games is known in the prior art. More specifically, card games heretofore devised and utilized for the purpose of entertaining players are known to consist basically of familiar, expected, and obvious structural configurations, notwithstanding the myriad of designs encompassed by the crowded prior art which has been developed for the fulfillment of countless objectives and requirements.

The prior art shows a large number of games, including card games. By way of example, U.S. Pat. No. 4,170,358 to Hancock discloses playing cards generally patterned after a conventional deck.

U.S. Pat. No. 4,480,840 to Chang discloses a card deck and associated board for playing games wherein the cards are a combination of conventional cards and fanciful cards.

Lastly, U.S. Pat. Nos. 4,071,247 to Breslow; 4,243,226 to Kendall and 4,369,976 to Chunn all disclose games of playing cards where the cards feature fanciful figures.

In this respect, card games to recreate some of the atmosphere of the Middle Ages according to the present invention substantially depart from the conventional concepts and designs of the prior art, and in doing so provide an apparatus primarily developed for the purpose of playing a card game of skill and chance which includes cards which evoke the atmosphere of the Middle Ages.

Therefore, it can be appreciated that there exists a continuing need for new and improved card games to recreate some of the atmosphere of the Middle Ages which can be used for playing a card game of skill and chance which includes cards which evoke the atmosphere of the Middle Ages. In this regard, the present invention substantially fulfills this need.

SUMMARY OF THE INVENTION

In view of the foregoing disadvantages inherent in the known types of card games now present in the prior art, the present invention provides an improved card game to recreate some of the atmosphere of the Middle Ages. As such, the general purpose of the present invention, which will be described subsequently in greater detail, is to provide a new and improved card game to recreate some of the atmosphere of the Middle Ages and methods which have all the advantages of the prior art and none of the disadvantages.

To attain this, the present invention essentially comprises a card game adapted to recreate some of the atmosphere of combat in the Middle Ages comprising, in combination, a rule book; a score pad; and a deck of cards, the deck of cards including 151 cards comprised of card types and card subdivisions as follows:

| Card Name | Number per deck | Value of Points |
|---|---|---|
| Land | | |
| Foot: | | |
| Imperial Guard | 1 | 6 |
| Line Infantry | 15 | 2 |
| Highlanders | 3 | 2 |
| Rangers | 3 | 2 |
| Foresters | 3 | 2 |
| Horse: | | |
| Imperial Horse | 1 | 9 |
| Heavy Calvary | 9 | 7 |
| Light Calvary | 15 | 6 |
| Range: | | |
| Yeoman Archers | 1 | 6 |
| Archers | 9 | 3 |
| Spearman | 15 | 2 |
| Naval | | |
| Flagships | 1 | 10 |
| Line Ships | 9 | 9 |
| Crews | 12 | 2 |
| Royal Marines | 1 | 6 |
| Marines | 12 | 4 |
| Fortifications | | |
| Towers | 12 | 12 |
| Gatehouses | 6 | 12 |
| Assault | | |
| Rams | 2 | |
| Catapults | 2 | |
| Personalities | | |
| Kings | 6 | 12 |
| Queens | 6 | 11 |
| Knights | 6 | 10 |
| Wizards | 2 | 9 |

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved card games to recreate some of the atmosphere of the: Middle Ages which have all the advantages of the prior art card games and none of the disadvantages.

It is another object of the present invention to provide new and improved card games to recreate some of the atmosphere of the Middle Ages which may be easily and efficiently manufactured and marketed.

It is a further object of the present invention to provide new and improved card games to recreate some of the atmosphere of the Middle Ages which are of a durable and reliable construction.

An even further object of the present invention is to provide new and improved card games to recreate some of the atmosphere of the Middle Ages which are susceptible of a low cost of manufacture with regard to both materials and labor, and which accordingly are then susceptible of low prices of sale to the consuming public, thereby making such card games to recreate some of the atmosphere of the Middle Ages economically available to the buying public.

Still yet another object of the present invention is to provide new and improved card games to recreate some of the atmosphere of the Middle Ages which provide in the apparatuses and methods of the prior art some of the advantages thereof, while simultaneously overcoming some of the disadvantages normally associated therewith.

Lastly, it is an object of the present invention to provide new and improved card games adapted to recreate some of the atmosphere of combat in the Middle Ages comprising, a rule book; a score pad; and a deck of cards, the deck of cards including a plurality of cards comprised of five different card type identifications vertically marked along one side including land, personalities, naval, fortifications and assault, each card also including horizontally across the top a subdivision identification and for land type cards a unit identification including foot, horse and range, each card also having on its face a picture indicative of the subdivision and a number representing the point value assigned to the card.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a rule book and score pad for the preferred embodiment of the Card Games to Recreate Some of the Atmosphere of the Middle Ages constructed in accordance with the principles of the present invention.

FIG. 2 is one Land type card of the deck adapted to be used in game of the present invention.

The same reference numerals refer to the same parts throughout the various FIG.s.

DESCRIPTION OF THE PREFERRED EMBODIMENT

Figure 3:
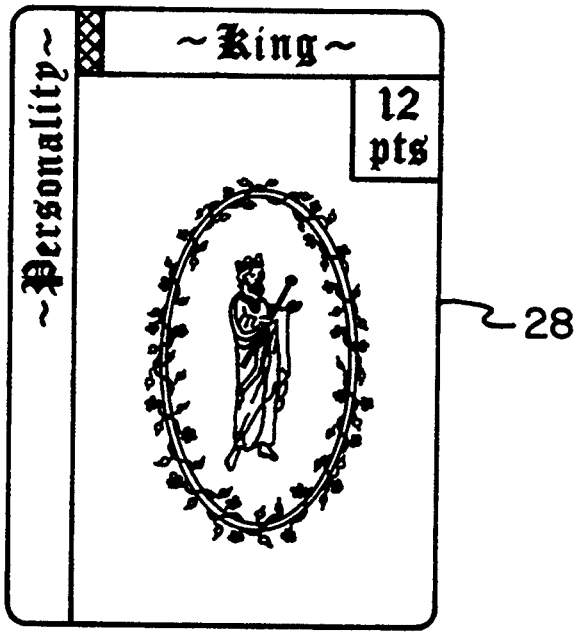
FIG. 3 is one Personality type card of the deck adapted to be used in game of the present invention.

With reference now to the drawings, and in particular to FIG. 1 thereof, the preferred embodiment of the new and improved card game to recreate some of the atmosphere of the Middle Ages embodying the principles and concepts of the present invention and generally designated by the reference numeral 10 will be described.

More specifically, it will be noted in the various Figures that the present invention is a game 10 which includes, in its broadest context, a rule book 12, a score pad 14 and a deck of cards 16.

The card game 10 of the present invention is played with a special deck which attempts to recreate some of the atmosphere of combat in the Middle Ages. The object of the game is to construct a complete hand, a Kingdom, composed of cards held up in your hand and held down spread face-up on the table, before your opponents do. The game may be played by two or more players up to six players.

The card game 10 includes rule book 12 reproducing the rules as set forth herein. The card game 10 also includes a score pad 14 for keeping score as the game proceeds.

The card game also includes a deck of cards 16. The deck of cards including 151 cards comprised of five different card type identifications vertically marked along one side. The type identifications are land, personalities, naval, fortifications and assault. Each of the cards also includes horizontally across the top a subdivision identification. For land type cards a unit identification is provided and includes foot, horse and range. Each card also has on its face a picture 38 indicative of the subdivision and a number value 40 assigned to the card.

The deck is made up of 151 cards organized not into suits, for the most part, but into five broad types. These types are:

b 1. Land Units These land unit cards 20 as represented in FIG. 2 represent the units that made up the armies during the period. These are subdivided into foot (infantry), horse (calvary), and range (archers and spearmen) subdivision units and each card is marked down a side vertically with the type 22 and horizontally across the top with a subdivision 24.

2. Personality Cards These personality cards 28 represent individuals. Note FIG. 3. There are six each of Kings, Queens and Knights, organized into suits by number (i.e. #1King+#1Queen+#1-Knight=#1Suit). Also, there are two Wizards, which may be played to the table for points or kept in the hand for defense as will be discussed later.

Figure 4:
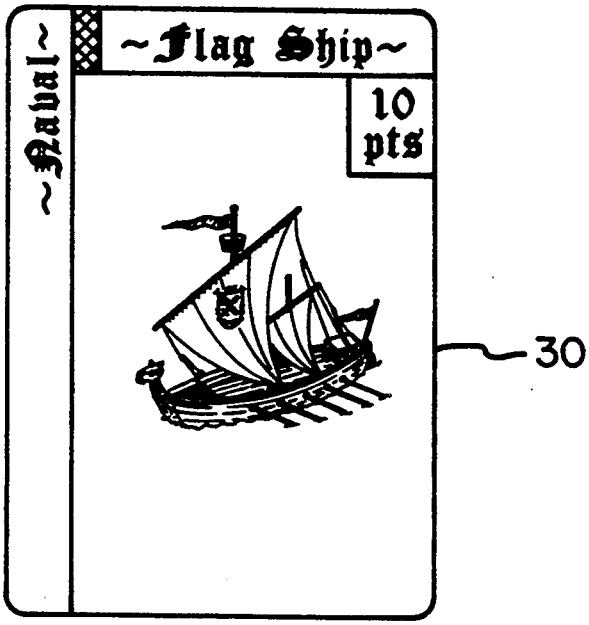
FIG. 4 is one Naval type card of the deck adapted to be used in game of the present invention.
Figure 5:
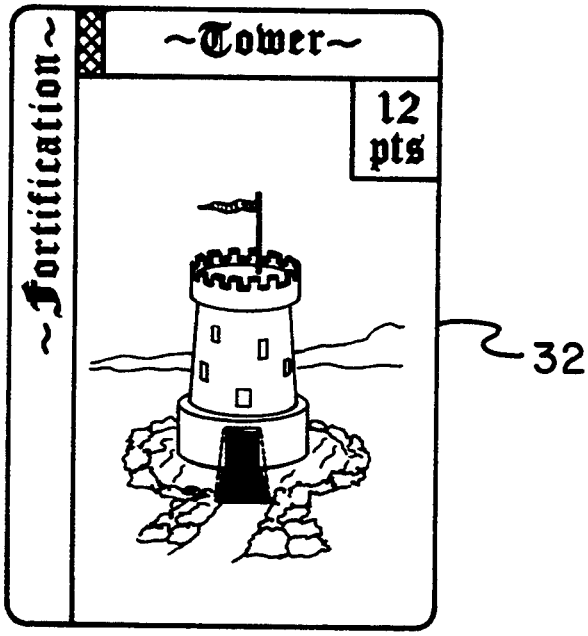
FIG. 5 is one Fortification type card of the deck adapted to be used in game of the present invention.
Figure 6:
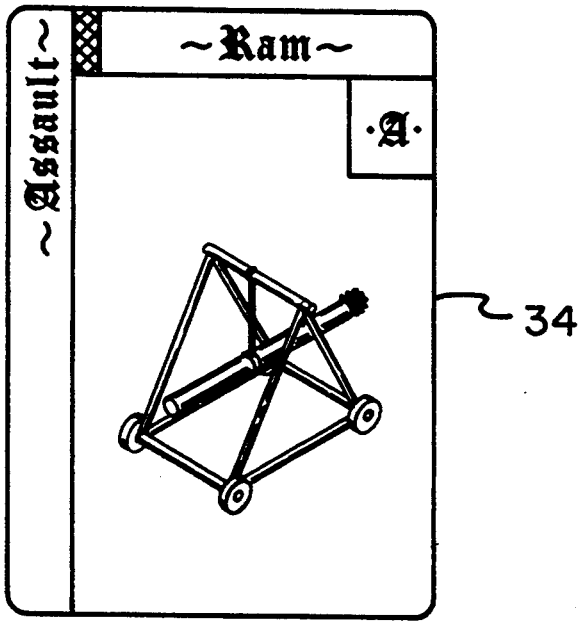
FIG. 6 is one Assault type card of the deck adapted to be used in game of the present invention.

3. Naval Units These naval cards 30 represent units that would be found in organized navies of the time. Note FIG. 4. These cards have a specialized order of play which will be discussed later.
4. Fortification Cards These fortification cards 32 represent the defensive constructions raised during the period. A complete castle is two towers and a gatehouse.
5. Assault Cards These assault cards 34 are offensive cards used to destroy the major assets of your opponent such as his ships and his fortifications.

A reference chart of the cards including number of each and their point value is as follows:

| Card Name | Number per deck | Value of Points |
|---|---|---|
| Land | | |
| Foot: | | |
| Imperial Guard | 1 | 6 |
| Line Infantry | 15 | 2 |
| Highlanders | 3 | 2 |
| Rangers | 3 | 2 |
| Foresters | 3 | 2 |
| Horse: | | |
| Imperial Horse | 1 | 9 |
| Heavy Calvary | 9 | 7 |
| Light Calvary | 15 | 6 |
| Range: | | |
| Yeoman Archers | 1 | 6 |
| Archers | 9 | 3 |
| Spearman | 15 | 2 |
| Naval | | |
| Flagships | 1 | 10 |
| Line Ships | 9 | 9 |
| Crews | 12 | 2 |
| Royal Marines | 1 | 6 |
| Marines | 12 | 4 |
| Fortifications | | |
| Towers | 12 | 12 |
| Gatehouses | 6 | 12 |
| Assault | | |
| Rams | 2 | / |
| Catapults | 2 | / |
| Personalities | | |
| Kings | 6 | 12 |
| Queens | 6 | 11 |
| Knights | 6 | 10 |
| Wizards | 2 | 9 |

Play begins with the dealer who shuffles the deck and gives each player seven cards, one at a time, face down, and then places the remainder in a neat pile in the middle of the table to become the stock.

The player to the dealer's left begins play by picking up the top card of the stock and placing it in his hand. The player, to win, must have in his hand three foot units (any type), two horse units (any type) and two range units (any type) and, on the table before him, one King, one Castle (two towers and one gatehouse) and one complete ship (one ship and one crew and one marine). To achieve this the cards are played in the five following ways:

1. Personality Cards—Kings, Queens and Knights—whether dealt to the player or picked up from the stock, are laid on the table once the player begins his turn, face up, or as soon as they are picked up from the stock. Any number of these cards may be played. These may mean that one player will have more Kings than necessary, which in turn means that other players will lack Kings. If, at some point in the game, all Kings have been played, yet some players are without one, then these players are eliminated from play at once. Their entire hand is gathered up and placed on the discard pile and they have no chance to win. Wizards may be placed on the table for their points or may be held in the hand for defense against an attack as discussed later. There is a bonus for collecting the King, Queen and Knight of the same suit. This will also be discussed later.
2. Fortification Cards—Towers and Gatehouses are laid on the table, face up, as soon as the player's turn begins or as soon as they are picked up from the stock. However, at no time may more than two towers or one gatehouse be played, as this combination is a full castle. Any other fortification cards drawn through the course of the game may be held in the hand to correct losses from enemy attacks or may be discarded.
3. Naval Cards—Ship, Crew and Marine cards must be laid down on the table in special order. A ship needs a crew to sail. Crews and marines need ships to prevent drowning. Therefore, a Ship and a Crew card must be laid down on the table together. This means that a Ship card must be held in the hand until a crew card is drawn to pilot her and, of course, vice-versa. A ship and a crew are a pair. Marines may be added later or laid down on the same turn or at the same time, but they cannot be laid down until a ship has been "launched". A launched ship is a ship and crew pair. A complete ship is a ship and a crew and a marine. A full ship is a ship and a crew and two marines.
4. Land Cards—Foot, Horse and Range units, whether dealt or picked up from the stock, are held in the hand to fulfill win requirements. The elite units (i.e. Yeoman Archers) are not required to win, merely worth more points than regular units and add flavor to the game. There is a bonus for collecting all three highland units or all three forest units or all three ranger units, but this will be discussed in Sec. iv. The may, of course, be discarded through the course of the game to make way for cards that are temporarily more important.
5. Assault Cards—Rams and Catapults are completely different from the other cards in that the are not needed for victory conditions and that they allow you to attack your enemies. Whether you are dealt an Assault card or drew it from the stock, you keep it in your hand until one of the other players lays down a card which is a suitable target. A Ram is used against a Tower and a Catapult is used against a Gatehouse or a Ship. When to use your card and who to use it against is entirely up to you. Once you decide to use it, it must be your turn. Show the card to the player who it is being used against, then place it and its target on the discard pile. In the case of a Ship, the enemy loses the ship, its crew and any and all Marines on board.

The player, after having drawn a card from the stock, plays all cards in his hand under the rules outlined above. If any cards are laid down on the table, the player must draw cards from the stock to fill his hand back up to seven cards. These cards may be played as part of the same turn. Thus, a player's turn may last some time and through any number of draws from the stock. The turn is over when the can no longer lay any cards on the table. A discard is made. At the end of the turn the player must have seven cards in his hand.

Play passes to the left. Each player begins his turn by drawing a card from either the top of the stock or the top of the discard pile. The cards are all played the same way as noted previously and the turn continues until this player can no longer lay any cards on the table. The player then discards and the play passes to the left.

The first player to complete his hand—1 King, 1 Castle and 1 complete Ship on the table, and in his hand, 3 Foot, 2 Horse and 2 Range—wins. The points of all the cards are added up and added to his score. No other players add any points except the one who wins. The first player to reach 500 wins.

There are five special rules:

1. If the King, Queen and Knight of the same suit are collected, then the player has established a "Royal House" and receives a 30 point bonus should he win. This is irregardless of other Personality cards held.
2. If a player has three ships more than any other player, then the player has established Control of the Seas, and receives a 100 point bonus should he win with all three ships intact.
3. The Wizard, if held in the hand and not laid on the table, has the ability to defend against attacks by Rams and Catapult. The player, when attacked, simply loses the Wizard in place of the asset attacked.

4. If the player gathers in his hand all three Highland units, or all three Forester units, or all three Ranger units, then he has achieve a special rank: Lord for the Highland units, Warden for the Forester units or Marshal for the Ranger units. There is a 20 point bonus for this should he win the game.
5. If a woman so wishes, her country may be ruled by a Queen. All Queens played by her would then be worth 12 points and all Kings would then be worth 11 points.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card game adapted to recreate some of the atmosphere of combat in the Middle Ages comprising:

a rule book;

a score pad;

a deck of cards, the deck of cards including a plurality of cards comprised of five different type identifications vertically marked along one side including type identifications of land, naval, fortifications, assault, and personalities with the land type identification further having subdivision identifications of foot, horse, and, range and with the foot subdivision identification including a number of cards named Imperial Guard, Line infantry, Highlander, Ranger, and Forester, the horse subdivision identification including a number of cards named Imperial Horse, Heavy Calvary, and Light Calvary, and the range subdivision identification including a number of cards named Yeoman Archers, Archers, and Spearman cards, and with the naval type identification including a number of cards named Flagship, Line Ship, Crew, Royal Marine, and Marine, the fortification type identification including a number of cards named Tower and Gatehouse, the assault type identification including a number of cards named Ram and Catapult, and the personalities type, identification including a number of cards named King, Queen, Knight, and Wizard cards and with each named card having an assigned point value.

2. A card game adapted to recreate some of the atmosphere of combat in the Middle Ages comprising, in combination:

a rule book;

a score pad;

a deck of cards, the deck of cards including 151 cards comprised of

| Card Name | Number per deck | Value of Points |
|---|---|---|
| Land | | |
| Foot: | | |
| Imperial Guard | 1 | 6 |
| Line Infantry | 15 | 2 |
| Highlanders | 3 | 2 |
| Rangers | 3 | 2 |
| Foresters | 3 | 2 |
| Horse: | | |
| Imperial Horse | 1 | 9 |
| Heavy Calvary | 9 | 7 |
| Light Calvary | 15 | 6 |
| Range: | | |
| Yeoman Archers | 1 | 6 |
| Archers | 9 | 3 |
| Spearman | 15 | 2 |
| Naval | | |
| Flagships | 1 | 10 |
| Line Ships | 9 | 9 |
| Crews | 12 | 2 |
| Royal Marines | 1 | 6 |
| Marines | 12 | 4 |
| Fortifications | | |
| Towers | 12 | 12 |
| Gatehouses | 6 | 12 |
| Assault | | |
| Rams | 2 | / |
| Catapults | 2 | / |
| Personalities | | |
| Kings | 6 | 12 |
| Queens | 6 | 11 |
| Knights | 6 | 10 |
| Wizards | 2 | 9] |

five different type identifications including type identifications of land, naval, fortifications, assault, and personalities with the land type identification further having subdivision identifications of foot, horse, and range and with the foot subdivision identification including a number of cards named Imperial Guard, Line infantry, Highlander, Ranger, and Forester, the horse subdivision identification including a number of cards named Imperial Horse, Heavy Calvary, and Light Calvary, and the range subdivision identification including a number of cards named Yeoman Archers, Archers, and Spearman cards, and with the naval type identification including a number of cards named Flagship, Line Ship, Crew, Royal Marine, and Marine, the fortification type identification including a number of cards named Tower and Gatehouse, the assault type identification including a number of cards named Ram and Catapult, and the personalities type identification including a number of cards named King, Queen, Knight, and Wizard cards and with each named card having an assigned point value, wherein the type identification, subdivision identification, name, number per deck, and assigned point value of the cards are as follows:

| Type Ident. | Sub-division Ident. | Name | Number per Deck | Point Value |
|---|---|---|---|---|
| Land | Foot | Imperial Guard | 1 | 6 |
| | | Line Infantry | 15 | 2 |
| | | Highlander | 3 | 2 |
| | | Ranger | 3 | 2 |
| | | Forester | 3 | 2 |
| | Horse | Imperial Horse | 1 | 9 |
| | | Heavy Calvary | 9 | 7 |
| | | Light Calvary | 15 | 6 |
| | Range | Yeoman Archer | 1 | 6 |
| | | Archer | 9 | 3 |
| | | Spearman | 15 | 2 |
| Naval | | Flagship | 1 | 10 |
| | | Line Ship | 9 | 9 |
| | | Crews | 12 | 2 |
| | | Royal Marine | 1 | 6 |
| | | Marine | 12 | 4 |
| Fortifications | | Tower | 12 | 12 |
| | | Gatehouse | 6 | 12 |
| Assault | | Rams | 2 | / |
| | | Catapult | 2 | / |
| Personalities | | King | 6 | 12 |
| | | Queen | 6 | 11 |
| | | Knight | 6 | 10 |
| | | Wizard | 2 | 9 |

* * * * *